US007499795B2

(12) United States Patent
Fetzmann et al.

(10) Patent No.: US 7,499,795 B2
(45) Date of Patent: Mar. 3, 2009

(54) METHOD AND DEVICE FOR ASSISTING IN THE NAVIGATION OF AN AIRPLANE ON THE GROUND AT AN AIRPORT

(75) Inventors: Fabien Fetzmann, Cugnaux (FR); Pierre Coldefy, Toulouse (FR); Stéphane Collins, Toulouse (FR)

(73) Assignee: AIRBUS France, Toulouse (FR)

( * ) Notice: Subject to any disclaimer, the term of this patent is extended or adjusted under 35 U.S.C. 154(b) by 36 days.

(21) Appl. No.: 11/759,165

(22) Filed: Jun. 6, 2007

(65) Prior Publication Data

US 2007/0299598 A1 Dec. 27, 2007

(30) Foreign Application Priority Data

Jun. 8, 2006 (FR) ..... 06 05077

(51) Int. Cl.
*G08G 5/04* (2006.01)

(52) U.S. Cl. ..... 701/120; 701/117; 340/972; 340/958

(58) Field of Classification Search ..... 701/117, 701/120

See application file for complete search history.

(56) References Cited

U.S. PATENT DOCUMENTS

| | | | | |
|---|---|---|---|---|
| 5,675,661 | A * | 10/1997 | Richman et al. | 382/104 |
| 6,246,320 | B1 | 6/2001 | Monroe | |
| 6,571,166 | B1 * | 5/2003 | Johnson et al. | 701/120 |
| 6,690,295 | B1 * | 2/2004 | De Boer | 340/951 |
| 6,912,461 | B2 * | 6/2005 | Poreda | 701/120 |
| 6,914,542 | B2 * | 7/2005 | Hutton | 340/958 |
| 2003/0160708 | A1 * | 8/2003 | Knoop | 340/958 |
| 2003/0200024 | A1 * | 10/2003 | Poreda | 701/120 |
| 2004/0090348 | A1 * | 5/2004 | Hutton | 340/958 |
| 2004/0225432 | A1 * | 11/2004 | Pilley et al. | 701/117 |
| 2007/0078591 | A1 * | 4/2007 | Meunier et al. | 701/120 |
| 2007/0078592 | A1 * | 4/2007 | Meunier et al. | 701/120 |
| 2007/0299598 | A1 * | 12/2007 | Fetzmann et al. | 701/120 |

FOREIGN PATENT DOCUMENTS

| | | |
|---|---|---|
| EP | 0714082 | 6/1996 |
| GB | 2393836 | 4/2004 |

OTHER PUBLICATIONS

Preliminary Search Report dated Jan. 18, 2007 with English translation.

* cited by examiner

*Primary Examiner*—Thomas G Black
*Assistant Examiner*—Shelley Chen
(74) *Attorney, Agent, or Firm*—Dickinson Wright, PLLC

(57) ABSTRACT

Method and device for assisting in the navigation of an airplane on the ground at an airport.

The device (1) comprises means (14) for transmitting an alarm signal, at least if an airplane position is not on a routing zone of the airport or if the orientation bearing-wise of the airplane on this routing zone does not correspond to a particular traffic direction.

18 Claims, 1 Drawing Sheet

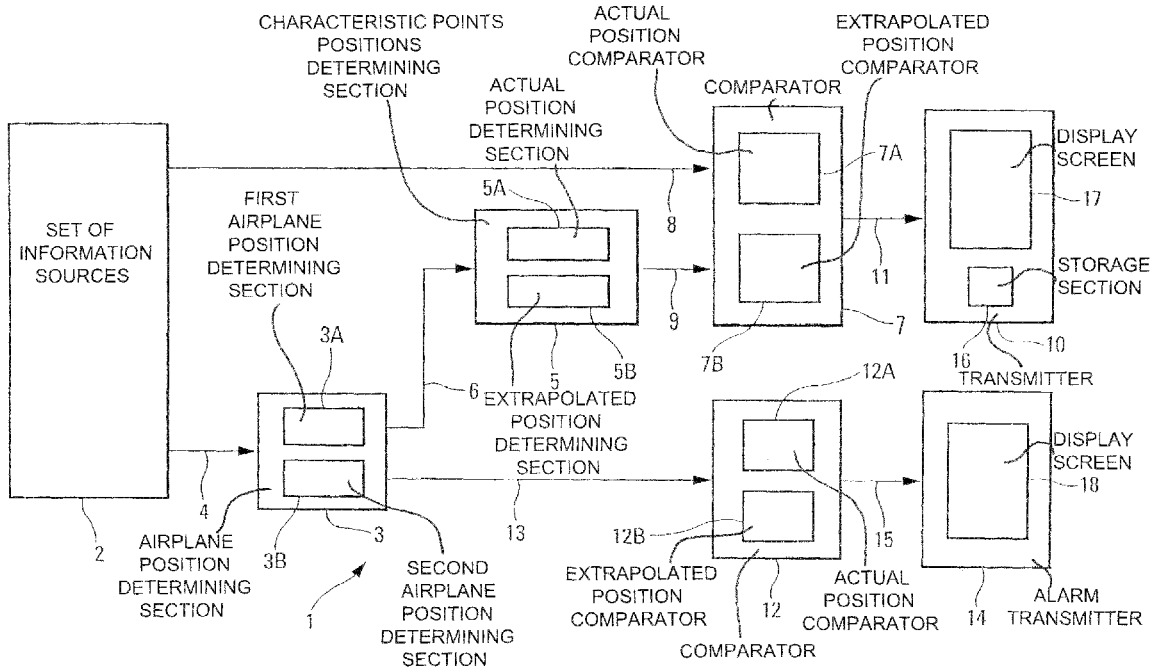

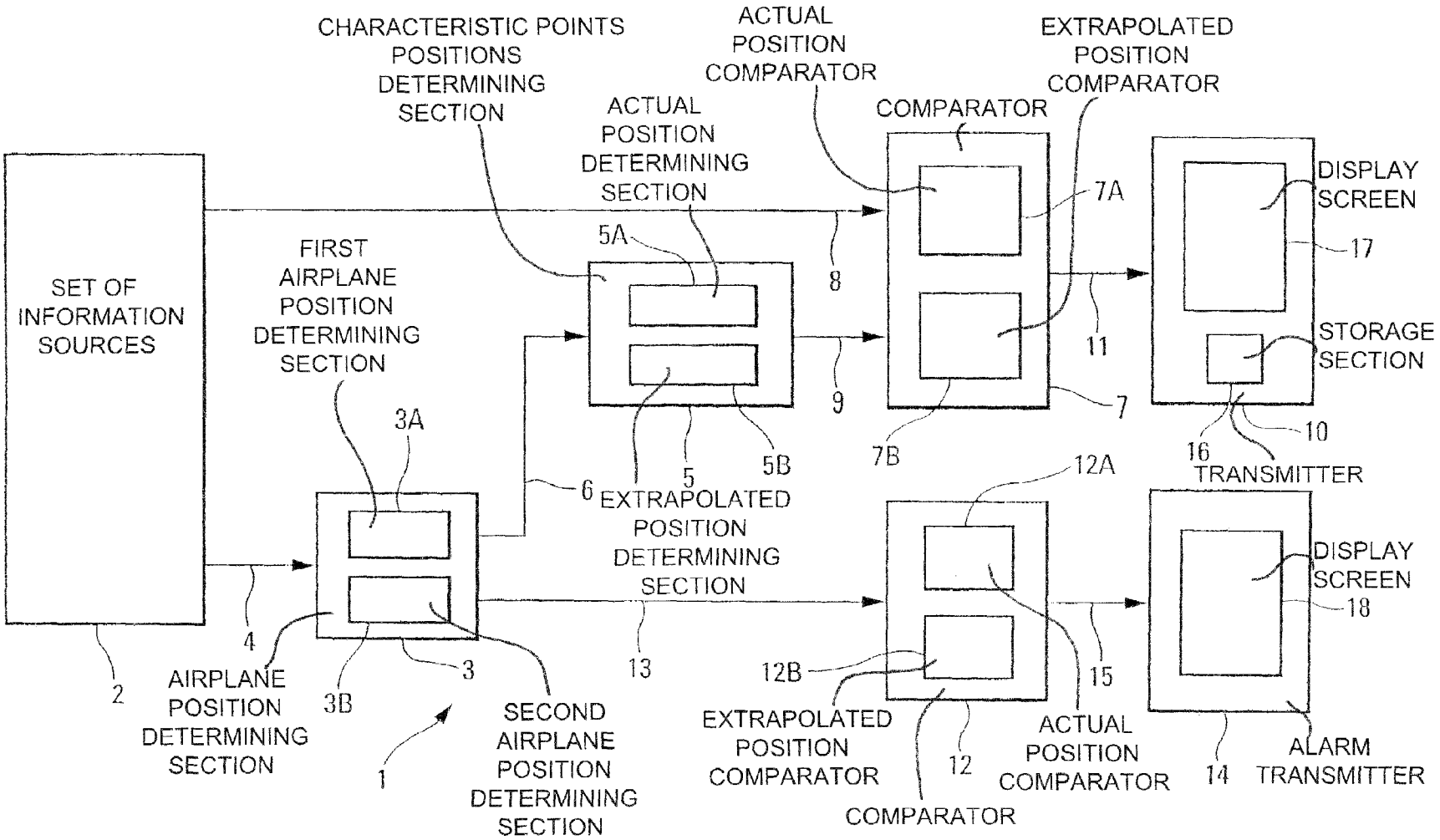
SET OF INFORMATION SOURCES
2
AIRPLANE POSITION DETERMINING SECTION
4
FIRST AIRPLANE POSITION DETERMINING SECTION
3A
3B
3
SECOND AIRPLANE POSITION DETERMINING SECTION
1
CHARACTERISTIC POINTS POSITIONS DETERMINING SECTION
6
ACTUAL POSITION DETERMINING SECTION
5A
5B
5
EXTRAPOLATED POSITION DETERMINING SECTION
13
ACTUAL POSITION COMPARATOR
8
9
COMPARATOR
7A
7B
7
EXTRAPOLATED POSITION COMPARATOR
11
12A
12B
12
EXTRAPOLATED POSITION COMPARATOR
15
ACTUAL POSITION COMPARATOR
COMPARATOR
DISPLAY SCREEN
17
STORAGE SECTION
10
16
TRANSMITTER
DISPLAY SCREEN
18
ALARM TRANSMITTER
14

METHOD AND DEVICE FOR ASSISTING IN THE NAVIGATION OF AN AIRPLANE ON THE GROUND AT AN AIRPORT

FIELD OF THE INVENTION

The present invention relates to a method and a device for assisting in the navigation of an airplane on the ground at an airport.

BACKGROUND OF THE RELATED ART

The complexity of some airports, the increase in air traffic, the existence of installations that are often ill-suited to airplanes which are increasingly large and numerous, create traffic difficulties on the runways and the taxiways of the airports, often leading to extended taxiing times, sometimes more or less serious incidents, and, unfortunately, also accidents.

In this context, an increasingly high number of critical situations are noted in which, through interpretation error, lack of vigilance or reaction time, the crew fails to observe the taxiing setpoints sent to it by the controllers, even official traffic procedures on the airport platforms. This can lead to take-offs on taxiways, uncontrolled runway approaches, and therefore intrusive disturbances of the poor visibility landing aid means used by other airplanes on approach, runway incursions, unauthorized take-offs, take-offs on a wrong runway, or quite simply failure to comply with the routing imposed by the controllers, so culminating in airport congestion, and consequently increasing the risk of the occurrence of the same errors for the other airplanes. Such situations are very hazardous since they endanger the lives of the occupants of the various airplanes.

For safety reasons, it is therefore important, not to say imperative, for each pilot to be able to be kept as effectively as possible in a state of awareness that is sufficient for his environment and, where appropriate, alerted when the situation becomes hazardous for himself or for the other airplanes.

Devices are known which make it possible, when navigating on the ground, to provide help for very specific cases. However, none of these known devices cover both statically and dynamically the variety of possible situations as mentioned above.

SUMMARY OF THE INVENTION

The present invention relates to a method of assisting in the navigation of an airplane on the ground at an airport, which makes it possible to remedy these drawbacks.

To this end, according to the invention, said method is noteworthy in that the following series of successive steps is carried out automatically and repetitively:

a) the current values of a plurality of parameters linked to the airplane are determined;

b) at least one airplane position is determined, corresponding to a position of the airplane, using said current values, and its orientation bearing-wise;

c) using said airplane position, said orientation bearing-wise and geometric characteristics of the airplane, characteristic positions of a plurality of characteristic points of the airplane are determined;

d) for each of said characteristic points:

d1) the characteristic position corresponding to a plurality of different zones of the airport is compared; and d2) if at least said characteristic position relative to one of said zones is such that a particular taxiing setpoint or a particular traffic procedure is not respected, a specific information item is transmitted; and e) e1) said airplane position is compared with a routing zone relative to a path that the airplane must follow on the airport; and e2) if said airplane position is not on said routing zone or if the orientation bearing-wise of the airplane on said routing zone does not correspond to a particular traffic direction, an alarm signal is transmitted.

Thus, with the invention, said method of assisting in navigation on the ground makes it possible to inform the pilot as early as possible of any navigation error or any failure to comply with taxiing setpoints. Taxiing setpoints should be understood, for example, to mean compliance with particular rules (limitations on weight, wing span, minimum turn radius, safety margins either side of the main landing gear of the airplane, prohibited directions, closed portions or portions with work being carried out, cul de sacs, limit speeds, mandatory stopping points) or any other information useful to navigation on the ground and officially published by the airport authorities. Consequently, with the invention, any abnormal situation of the airplane relative to its environment, and in particular any failure to comply with taxiing setpoints or official traffic procedures, are flagged by the transmission of an appropriate signal (namely a specific information item or an alarm signal depending on the situation).

Also, thanks to the repetitive and automatic way in which the method according to the invention is implemented, which is therefore permanent and requires no action on the part of the pilot, said pilot has a novel aid, which fits in with the existing procedures, for carrying out his navigation and ground piloting task.

It will be noted that, compared to the abovementioned state of the art, the method according to the invention makes it possible to take account of all cases linked to the taxiing setpoints and airplane traffic procedures. Appropriate processing of the specific information items transmitted, based on knowledge of human automatisms and procedures established for airplane piloting and navigation activities, makes it possible to render this information easy to use by the crew.

Furthermore, advantageously, the following operations are also carried out in the step d):

comparisons are made by comparing the current values of a plurality of parameters linked to the airplane with reference values; and in the step d2), these comparisons are taken into account to check whether all the taxiing setpoints and traffic procedures are respected.

Moreover, advantageously, if several specific information items must be transmitted in the step d2), these specific information items are transmitted in a predetermined priority order.

In a first embodiment (of static type), a first airplane position corresponding to an actual position of the airplane is used as the airplane position. Preferably, this first airplane position corresponds to the position on the airplane of a receiving antenna of a satellite positioning system, for example of GPS (Global Positioning System) type.

Advantageously, in this first embodiment, the following characteristic positions are determined in the step c):

the position of the nose of the airplane;

the positions of the wheels of the airplane;

the position of the barycenter of the main landing gear of the airplane;

the positions of the ends of the wings of the airplane;

the position of the end of the vertical stabilizer of the airplane; and the positions of the jet engines of the airplane.

Furthermore, in this first embodiment, in the step e2), an alarm signal is transmitted if one of the following conditions is satisfied:

- the position of the barycenter of the main landing gear of the airplane is not on the routing zone (that is, on the zone relative to the path that the airplane should follow on the airport);
- the position of said barycenter of the main landing gear of the airplane is on said routing zone, but the difference between the current orientation bearing-wise of the airplane and the (prescribed) traffic direction on this routing zone is greater than a predefined value.

Moreover, in a second embodiment (of dynamic type) which can be implemented in addition to or as a variant of the first abovementioned embodiment, a second airplane position corresponding to an extrapolated position relative to the airplane is used as the airplane position. This second embodiment makes it possible, through extrapolations detailed below, to detect any change from the current situation to a potentially hazardous situation, and to flag this change by the transmission of an appropriate signal, and this sufficiently in advance (preferably a few seconds before the anticipated occurrence of this hazardous situation) to allow time for the crew to react by taking appropriate measures.

In this second embodiment, the following operations are carried out in the step b) to determine said second airplane position:

- a first airplane position is determined (for example representing said first airplane position of the abovementioned first embodiment) which corresponds to the actual position of the airplane;
- the current speed of said first airplane position and the current yaw speed of the airplane determined in the step a), and a predetermined time interval, are used to determine said second airplane position which corresponds to an extrapolated position of the nose of the airplane at the end of said time interval relative to the current instant.

Furthermore, in this second embodiment, the following characteristic positions are determined in the step c):

- the extrapolated position of the nose of the airplane;
- the extrapolated positions of the wheels of the airplane;
- the extrapolated position of the barycenter of the main landing gear of the airplane;
- the extrapolated positions of the ends of the wings of the airplane;
- the extrapolated position of the end of the vertical stabilizer of the airplane; and
- the extrapolated positions of the jet engines of the airplane.

Moreover, advantageously, in this second embodiment, an alarm signal is transmitted in the step e2) if one of the following two conditions is satisfied:

- the extrapolated position of the barycenter of the main landing gear of the airplane is not on the routing zone;
- the extrapolated position of the barycenter of the main landing gear of the airplane is on the routing zone, but the difference between the current orientation bearing-wise of the airplane and the traffic direction on this routing zone is greater than a predefined value.

Moreover, whatever the embodiment (said abovementioned first embodiment or said abovementioned second embodiment), at least some of the following zones of the airport are advantageously used in the step d):

- at least one shoulder zone;
- at least one taxiway zone;
- at least one stop bar zone;
- at least one runway zone;
- at least one runway intersection zone;
- at least one parking zone;
- at least one routing zone; and
- at least one fixed obstacle zone.

In the context of the present invention:

- a shoulder zone corresponds to an area of the airport which is defined around an area protecting a maneuvering area of said airport;
- a taxiway zone corresponds to an area of the airport which is defined around a maneuvering area of said airport, intended for airplanes to taxi between a runway zone and a parking zone specified below;
- a stop bar zone corresponds to an area of the airport which is defined around a ground marking showing the limit between a taxiway and a runway of said airport;
- a runway zone corresponds to an area of the airport which is defined around a maneuvering area of said airport, intended for the airplane to take off or land;
- a runway intersection zone corresponds to an area of the airport which is defined around a maneuvering area of said airport relative to the intersection of at least two runways;
- a parking zone corresponds to an area of the airport which is defined around a maneuvering area of said airport intended for parking the airplane;
- a routing zone corresponds to an area of the airport which is defined around a succession of maneuvering areas; and
- a fixed obstacle zone corresponds to an area of the airport which is defined around elements with which the airplane may come into collision.

The present invention also relates to a device for assisting in the navigation of an airplane on the ground, in particular a transport airplane, at an airport.

According to the invention, said device is noteworthy in that it comprises the following automatic means:

- first means for determining the current values of a plurality of parameters linked to the airplane;
- second means for determining at least one airplane position (abovementioned first airplane position and/or second airplane position) corresponding to a position of the airplane, using said current values, and its orientation bearing-wise;
- third means for determining, using said airplane position, said orientation bearing-wise and geometric characteristics of the airplane, characteristic positions of a plurality of characteristic points of the airplane;
- first comparison means for comparing, for each of said characteristic points, the characteristic position corresponding to a plurality of different zones of the airport;
- first transmission means for transmitting a specific information item, if a characteristic position relative to one of said zones is such that a particular taxiing setpoint or a particular traffic procedure is not respected;
- second comparison means for comparing said airplane position with a routing zone relative to a path that the airplane must follow on the airport; and
- second transmission means for transmitting an alarm signal, if said airplane position is not on said routing zone or if the orientation bearing-wise of the airplane on said routing zone does not correspond to a particular traffic direction.

In the context of the present invention, said (first and/or second) transmission means can be of audible and/or visual type.

BRIEF DESCRIPTION OF THE DRAWING

The single FIGURE of the appended drawing will clearly show how the invention can be implemented. This single FIGURE is the block diagram of a device to assist in the navigation on the ground according to the invention.

DETAILED DESCRIPTION OF THE INVENTION

The device 1 according to the invention is diagrammatically represented in the FIGURE and is intended to assist the pilot of an airplane, in particular of a transport airplane, when navigating said airplane on the ground (not shown) at an airport.

For this, said device 1 comprises, as a general rule:

- a set 2 of information sources that make it possible to determine the current values of a plurality of parameters specified below, which are linked to the airplane;
- means 3 which are linked via a link 4 to said set 2 of information sources and which are designed to determine, using current values received from said set 2, at least one airplane position corresponding to a particular position of the airplane, specified below. These means 3 also determine the orientation bearing-wise of said airplane;
- means 5 which are linked via a link 6 to said means 3 and which are designed to determine, using said airplane position and said orientation bearing-wise received from said means 3, and using particular geometric characteristics of the airplane, characteristic positions of a plurality of characteristic points (specified below) of the airplane;
- comparison means 7 which are linked, respectively via links 8 and 9, to said set 2 and to said means 5 and which are designed in such a way as to compare, for each of the characteristic points received from said means 5, the characteristic position corresponding to a plurality of different zones of the airport. Said means 7 are also designed in such a way as to compare the current values of a plurality of parameters of the airplane, received from said set 2, with corresponding predetermined reference values;
- transmission means 10 which are linked via a link 11 to said comparison means 7 and which are designed in such a way as to transmit a specific information item specified below if, according to the comparisons implemented by said means 7, a characteristic position relative to one of said zones and/or the value of a current parameter relative to its reference value are such that at least one particular taxiing setpoint and/or at least one particular traffic procedure is not respected;
- comparison means 12 which are linked via a link 13 to said means 3 and which are designed to compare the airplane position (received from said means 3) with a routing zone which is defined by a certain number of values which, usually, describe a path which is imposed on the airplane at the airport; and
- transmission means 14 which are linked via a link 15 to said comparison means 12 and which are designed so as to transmit an alarm signal if, according to the comparison implemented by said means 12, said airplane position is not on said routing zone or the orientation bearing-wise of the airplane on said routing zone does not correspond to a particular traffic direction.

Thus, the device 1 according to the invention makes it possible to inform the pilot of the airplane as early as possible of any navigation error or of any failure to comply with taxiing setpoints. Taxiing setpoints should be understood, for example, to mean compliance with the following rules: limitations on weight, wing span, minimum turn radius, safety margins either side of the main landing gear of the airplane, prohibited directions, closed portions or portions with work being carried out, cul de sacs, limit speeds, mandatory stopping points, or any other information useful to navigation on the ground and officially published by the airport authorities. Consequently, using said device 1, any abnormal situation of the airplane relative to its environment, and in particular any failure to comply with taxiing setpoints or official traffic procedures, are flagged to the pilot of the airplane by the transmission of an appropriate signal (namely a specific information item via transmission means 10 or an alarm signal via transmission means 14).

Furthermore, the device 1 according to the invention is automatic and requires no action on the part of the pilot. The pilot of the airplane can therefore focus all his attention on other tasks, and in particular on piloting tasks.

It will also be noted that, compared to the state of the art, the device 1 according to the invention makes it possible to take into account all cases linked to the taxiing setpoints and to the airplane traffic procedures. An appropriate processing of the specific information items transmitted, based on knowledge of human automatisms and of the procedures established for the airplane piloting and navigation activities, makes it possible to render this information easy to use by the crew.

Moreover, if according to the comparisons made by the comparison means 7, the transmission means 10 need to send a plurality of specific information items, said means 10 transmit these specific information items in a predetermined priority order (specified below) which is, for example, stored in a storage means 16 incorporated in said transmission means 10.

In one particular embodiment, said transmission means 10 comprise a display screen 17 designed to display any specific information item that needs to be transmitted, for example in graphic form and/or in textual form. Similarly, said transmission means 14 comprise a display screen 18 that makes it possible to display, also textually and/or graphically, any alarm signal having to be transmitted. Obviously, said transmission means 10 and 14 can also comprise usual means for transmitting audible signals.

Said comparison means 7 use at least some of the following zones (not represented) of the airport:

- at least one shoulder zone;
- at least one taxiway zone;
- at least one stop bar zone;
- at least one runway zone;
- at least one runway intersection zone;
- at least one parking zone;
- at least one routing zone; and
- at least one fixed obstacle zone.

In the context of the present invention:

- a shoulder zone corresponds to an area of the airport which is defined around an area protecting a maneuvering area of said airport;
- a taxiway zone corresponds to an area of the airport which is defined around a maneuvering area of said airport, intended for airplanes to taxi particularly between a runway zone and a parking zone specified below;
- a stop bar zone corresponds to an area of the airport which is defined around a ground marking showing the limit between a taxiway and a runway of said airport;
- a runway zone corresponds to an area of the airport which is defined around a maneuvering area of said airport, intended for the airplane to take off or land;

a runway intersection zone corresponds to an area of the airport which is defined around a maneuvering area of said airport relative to the intersection of at least two runways;

a parking zone corresponds to an area of the airport which is defined around a maneuvering area of said airport intended for parking the airplane;

a routing zone corresponds to an area of the airport which is defined around a succession of maneuvering areas; and a fixed obstacle zone corresponds to an area of the airport which is defined around elements with which the airplane may come into collision.

In a first embodiment, said means 3 comprise an element 3A which is designed to determine a first airplane position corresponding to an actual position of the airplane. Preferably, this first airplane position corresponds to the position on the airplane of a receiving antenna (typically being part of said set 2) of a usual satellite positioning system.

In this first embodiment, said means 5, 7 and 12 comprise corresponding elements 5A, 7A and 12A, specified below.

More particularly, said element 5A determines the following characteristic positions of the airplane:

the position of the nose of the airplane;

the positions of all the wheels of the airplane, including the nose wheel (which can comprise two parallel wheels);

the position of the barycenter of the main landing gear of the airplane (at the wing root level);

the positions of the ends of the wings of the airplane;

the position of the end of the vertical stabilizer of the airplane; and the positions of the jet engines of the airplane.

For this, said element 5A uses said first airplane position and a predetermined vector offset of the corresponding characteristic points (nose, wheels, barycenter of the landing gear, ends of wings and of vertical stabilizer, jet engines) relative to the point of the airplane where said first airplane position is measured.

Furthermore, said element 12A checks whether the actual position of the airplane received from said element 3A is in the routing zone. Also, said element 12A orders said transmission means 10 to transmit an alarm signal if one of the following conditions is satisfied:

the position of the barycenter of the main landing gear of the airplane is not in the routing zone;

the position of said barycenter of the main landing gear of the airplane is in the routing zone, but the difference between the current orientation bearing-wise of the airplane and the traffic direction in this routing zone is greater than a predefined value, for example 150°.

In this first embodiment, the following situations can arise:

for the position of the barycenter of the main landing gear of the airplane:

if said position is in the shoulder zone, a level 1 information item of non-compliance with safety margins is transmitted, for example of TSMCF (Taxiway Safety Margins Conformance Failure) type;

if said position is in the taxiway zone, for which a pavement charge number (PCN) value is less than the aircraft charge number (ACN) value, a level 1 taxiway safety margins conformance (TSMCF) information item is transmitted;

if said position is in the taxiway zone and this zone leads nowhere or is closed, a level 1 taxiroute conformance (TCONF) information item is transmitted;

if said position is in a CAT I stop bar zone and outside of the routing zone and the traffic conditions present non-degraded visibility conditions, called "non-LVP", a level 3 runway incursion avoidance (RIA) information item is transmitted. There are usually CAT I (at 150 meters from the runway) to CAT III (at 90 meters from the runway) stop bars. The degraded visibility conditions are called "LVP" (Low Visibility Procedures) and the non-degraded visibility conditions are called "non-LVP";

if said position is in a CAT II or III stop bar zone and outside the routing zone and the traffic conditions are said to be "LVP", a level 3 runway incursion avoidance (RIA) information item is transmitted;

if said position is in the runway zone and outside the routing zone, a level 3 runway incursion avoidance (RIA) information item is transmitted; if said position is in the fixed obstacle zone, a level 3, level 1 fixed obstacle avoidance (FOA) information item is transmitted;

if said position is in the taxiway zone and the current position of the throttle reaches a specific value (FLEX TOGA—take-off thrust), a level 3 taxiway take-off prevention (TTOP) information item is transmitted;

for the position of the nose of the airplane:

if said position is in the CAT I stop bar zone and outside the routing zone and the traffic conditions are said to be "non-LVP", a level 3runway incursion avoidance (RIA) information item is transmitted;

if said position is in the CAT II or III stop bar zone and outside the routing zone and the traffic conditions are said to be "LVP", a level 3 runway incursion avoidance (RIA) information item is transmitted;

if said position is in the runway zone and outside the routing zone, a level 3 runway incursion avoidance (RIA) information item is transmitted;

if said position is in the fixed obstacle zone, a level 3, level 1 fixed obstacle avoidance (FOA) information item is transmitted;

for the position of each wheel of the airplane:

if said position is in the shoulder zone, a level 1 taxiway safety margins conformance (TSMCF) information item is transmitted;

if said position is in the taxiway zone, for which a pavement charge number (PCN) value is less than the aircraft charge number (ACN) value, a level 1 taxiway safety margins conformance (TSMCF) information item is transmitted;

if said position is in the fixed obstacle zone, a level 3, level 1 fixed obstacle avoidance (FOA) information item is transmitted;

for the positions of the ends of the wings:

if said position is in the fixed obstacle zone, a level 3, level 1 fixed obstacle avoidance (FOA) information item is transmitted;

for the position of the end of the vertical stabilizer:

if said position is in the fixed obstacle zone, a level 3, level 1 fixed obstacle avoidance (FOA) information item is transmitted; and for the position of each jet engine of the airplane:

if said position is in a taxiway zone, for which the blast of the jet engines is limited, and if the interpretation of the current and static values of the engine parameters indicates that the blast is greater than this limit, a level 1 taxiway safety margins conformance (TSMCF) information item is transmitted; and if said position is in the fixed obstacle zone, a level 3, level 1 fixed obstacle avoidance (FOA) information item is transmitted.

In a second embodiment, said means 3 comprise an element 3B which is designed to determine a second airplane position corresponding to an extrapolated position relative to the airplane. Said element 3B carries out the following operations to determine this second airplane position:

it determines a first airplane position which corresponds to the actual position of the airplane; and it determines, using the current speed of said first airplane position and the current yaw speed of the airplane determined by the set 2, and a predetermined time interval, said second airplane position which corresponds to an extrapolated position of the nose of the airplane at the end of said time interval relative to the current instant.

In this second embodiment, said means 5, 7 and 12 comprise corresponding elements 5B, 7B and 12B, specified below.

More specifically, said element 5B determines the following characteristic positions of the airplane:

the extrapolated position of the nose of the airplane;

the extrapolated positions of all the wheels of the airplane, including the nose wheel (which can comprise two parallel wheels);

the extrapolated position of the barycenter of the main landing gear of the airplane (at wing root level);

the extrapolated positions of the ends of the wings of the airplane;

the extrapolated position of the end of the vertical stabilizer of the airplane; and the extrapolated positions of the jet engines of the airplane.

For this, said element 5B uses said second airplane position and a predetermined vector offset of the corresponding characteristic points (nose, wheels, barycenter of the landing gear, ends of wings and of vertical stabilizer, jet engines).

Furthermore, said element 12B orders said transmission means 14 to transmit an alarm signal, if one of the following conditions is satisfied:

the extrapolated position of the barycenter of the main landing gear of the airplane is not in the routing zone;

the extrapolated position of the barycenter of the main landing gear of the airplane is in the routing zone, but the difference between the current orientation bearing-wise of the airplane and the traffic direction in this routing zone is greater than a predefined value, for example 150°.

In this second embodiment, the following situations can arise:

for said second airplane position (extrapolated position):

if said position is in the runway zone and outside the routing zone and said first airplane position (actual position) is at an altitude less than a predetermined value H1 (for example, 1000 feet, airplane on approach), a level 2 runway incursion avoidance (RIA) information item is transmitted;

if said position is in the runway zone and outside the routing zone and said first airplane position is at an altitude less than a predetermined value H2 (for example, 500 feet, airplane on approach), a level 3 runway incursion avoidance (RIA) information item is transmitted;

for the extrapolated position of the barycenter of the main landing gear of the airplane:

if said position is in the shoulder zone, a level 0 taxiway safety margins conformance (TSMCF) information item is transmitted;

if said position is in the taxiway zone, for which a pavement charge number (PCN) value is less than the aircraft charge number (ACN) value, a level 0 taxiway safety margins conformance (TSMCF) information item is transmitted;

if said position is in the taxiway zone and this zone leads nowhere or is closed, a level 0 taxiroute conformance (TCONF) information item is transmitted;

if said position is in the CAT I stop bar zone and outside the routing zone and the traffic conditions are said to be "non-LVP", a level 2 runway incursion avoidance (RIA) information item is transmitted;

if said position is in the CAT I stop bar zone and outside the routing zone and the traffic conditions are said to be "LVP", a level 3 runway incursion avoidance (RIA) information item is transmitted;

if said position is in the CAT II or III stop bar zone and outside the routing zone and the traffic conditions are said to be "LVP", a level 2 runway incursion avoidance (RIA) information item is transmitted;

if said position is in the runway zone and outside the routing zone, a level 2 runway incursion avoidance (RIA) information item is transmitted;

if said position is in the fixed obstacle zone, a level 0 fixed obstacle avoidance (FOA) information item is transmitted;

if said position is in the taxiway zone and the current position of the throttle reaches a specific value (FLEX TOGA—take-off thrust), a level 3 taxiway take-off prevention (TTOP) information item is transmitted;

for the extrapolated position of the nose of the airplane:

if said position is in the CAT I stop bar zone and outside the routing zone and the traffic conditions are said to be "non-LVP", a level 2 runway incursion avoidance (RIA) information item is transmitted;

if said position is in the CAT I stop bar zone and outside the routing zone and the traffic conditions are said to be "LVP", a level 3 runway incursion avoidance (RIA) information item is transmitted;

if said position is in the CAT II or III stop bar zone and outside the routing zone and the traffic conditions are said to be "LVP", a level 2 runway incursion avoidance (RIA) information item is transmitted;

if said position is in the runway zone and outside the routing zone, a level 2 runway incursion avoidance (RIA) information item is transmitted; if said position is in the fixed obstacle zone, a level 0 fixed obstacle avoidance (FOA) information item is transmitted;

for the extrapolated position of each wheel of the airplane;

if said position is in the shoulder zone, a level 0 taxiway safety margins conformance (TSMCF) information item is transmitted;

if said position is in the taxiway zone, for which a pavement charge number (PCN) value is less than the aircraft charge number (ACN) value, a level 0 taxiway safety margins conformance (TSMCF) information item is transmitted;

if said position is in the fixed obstacle zone, a level 0 fixed obstacle avoidance (FOA) information item is transmitted;

for the extrapolated position of the ends of the wings:

if said position is in the fixed obstacle zone, a level 0 fixed obstacle avoidance (FOA) information item is transmitted;

for the extrapolated position of the end of the vertical stabilizer:

if said position is in the fixed obstacle zone, a level 0 fixed obstacle avoidance (FOA) information item is transmitted;

for the extrapolated position of each jet engine:

if said position is in a taxiway zone, for which the blast of the jet engines is limited, and if the interpretation of the current and static values of the engine parameters indicates that the blast is greater than this limit, a level 0 taxiway safety margins conformance (TSMCF) information item is transmitted; and if said position is in the fixed obstacle zone, a level 0 fixed obstacle avoidance (FOA) information item is transmitted.

In the context of the present invention, said first and second abovementioned embodiments can, obviously, be implemented separately. However, in a third (preferred) embodiment, said first and second abovementioned embodiments are implemented simultaneously. In this case, said means 3, 5, 7 and 12 comprise, each time, respectively said elements 3A and 3B, 5A and 5B, 7A and 7B, 12A and 12B.

It will be noted that, in the context of the present invention, when several information items are transmitted simultaneously, the processing priority (stored in the storage means 16) is such that:

the level 3 information item is the highest priority and the level 0 information item is the lowest priority; and information items concerning runway incursions must, in all cases, be dealt with and presented to the pilot, whatever their level.

The invention claimed is:

1. A method of assisting in the navigation of an airplane on the ground at an airport, which automatically and repetitively carries out the following series of successive steps:

a) the current values of a plurality of parameters-linked to the airplane are determined;

b) at least one airplane position is determined, corresponding to a position of the airplane, using said current values, and its orientation bearing-wise;

c) using said airplane position, said orientation bearing-wise and geometric characteristics of the airplane, characteristic positions of a plurality of characteristic points of the airplane are determined;

d) for each of said characteristic points:

d1) the characteristic position corresponding to a plurality of different zones of the airport is compared; and d2) if at least said characteristic position relative to one of said zones is such that a particular taxiing setpoint or a particular traffic procedure is not respected, a specific information item is transmitted; and e) e1) said airplane position is compared with a routing zone relative to a path that the airplane must follow on the airport; and e2) if said airplane position is not on said routing zone or if the orientation bearing-wise of the airplane on said routing zone does not correspond to a particular traffic direction, an alarm signal is transmitted.

2. The method as claimed in claim 1, wherein the following operations are also carried out in the step d):

comparisons are made by comparing the current values of a plurality of parameters linked to the airplane with reference values; and in the step d2), these comparisons are taken into account to check whether all the taxiing setpoints and traffic procedures are respected.

3. The method as claimed in claim 1, wherein, if several specific information items must be transmitted in the step d2), these specific information items are transmitted in a predetermined priority order.

4. The method as claimed in claim 1, wherein a first airplane position corresponding to an actual position of the airplane is used as the airplane position.

5. The method as claimed in claim 4, wherein said first airplane position corresponds to the position on the airplane of a receiving antenna of a satellite positioning system.

6. The method as claimed in claim 4, wherein, in the step c), the following characteristic positions are determined:

the position of the nose of the airplane;

the positions of the wheels of the airplane;

the position of the barycenter of the main landing gear of the airplane;

the positions of the ends of the wings of the airplane;

the position of the end of the vertical stabilizer of the airplane; and the positions of the jet engines of the airplane.

7. The method as claimed in claim 4, wherein, in the step d), at least some of the following zones of the airport are used:

at least one shoulder zone;

at least one taxiway zone;

at least one stop bar zone;

at least one runway zone;

at least one runway intersection zone;

at least one parking zone;

at least one routing zone; and at least one fixed obstacle zone.

8. The method as claimed in claim 4, wherein, in the step e2), an alarm signal is transmitted if one of the following conditions is satisfied:

the position of the barycenter of the main landing gear of the airplane is not on the routing zone;

the position of said barycenter of the main landing gear of the airplane is on the routing zone, but the difference between the current orientation bearing-wise of the airplane and the traffic direction on this routing zone is greater than a predefined value.

9. The method as claimed in claim 1, wherein a second airplane position corresponding to an extrapolated position relative to the airplane is used as the airplane position.

10. The method as claimed in claim 9, wherein, in the step b), the following operations are carried out to determine said second airplane position:

a first airplane position is determined which corresponds to the actual position of the airplane;

the current speed of said first airplane position and the current yaw speed of the airplane determined in the step a), and a predetermined time interval, are used to determine said second airplane position which corresponds to an extrapolated position of the nose of the airplane at the end of said time interval relative to the current instant.

11. The method as claimed in claim 9, wherein, in the step c), the following characteristic positions are determined:

the extrapolated position of the nose of the airplane;

the extrapolated positions of the wheels of the airplane;

the extrapolated position of the barycenter of the main landing gear of the airplane;

the extrapolated positions of the ends of the wings of the airplane;

the extrapolated position of the end of the vertical stabilizer of the airplane; and the extrapolated positions of the jet engines of the airplane.

12. The method as claimed in claim 9, wherein, in the step d), at least some of the following zones of the airport are used:

at least one shoulder zone;

at least one taxiway zone;

at least one stop bar zone;

at least one runway zone;

at least one runway intersection zone;

at least one parking zone;

at least one routing zone; and at least one fixed obstacle zone.

13. The method as claimed in claim 9, wherein, in the step e2), an alarm signal is transmitted if one of the following two conditions is satisfied:

the extrapolated position of the barycenter of the main landing gear of the airplane is not on the routing zone;

the extrapolated position of the barycenter of the main landing gear of the airplane is on the routing zone, but the difference between the current orientation bearing-wise of the airplane and the traffic direction on this routing zone is greater than a predefined value.

14. A device for assisting in the navigation of an airplane on the ground at an airport, which comprises:

first means for determining the current values of a plurality of parameters linked to the airplane;

second means for determining at least one airplane position corresponding to a position of the airplane, using said current values, and its orientation bearing-wise;

third means for determining, using said airplane position, said orientation bearing-wise and geometric characteristics of the airplane, characteristic positions of a plurality of characteristic points of the airplane;

first comparison means for comparing, for each of said characteristic points, the characteristic position corresponding to a plurality of different zones of the airport;

first transmission means for transmitting a specific information item, if a characteristic position relative to one of said zones is such that a particular taxiing setpoint or a particular traffic procedure is not respected;

second comparison means for comparing said airplane position with a routing zone relative to a path that the airplane must follow on the airport; and second transmission means for transmitting an alarm signal, if said airplane position is not on said routing zone or if the orientation bearing-wise of the airplane on said routing zone does not correspond to a particular traffic direction.

15. The device as claimed in claim 14, wherein said transmission means are of audible type.

16. The device as claimed in claim 14, wherein said transmission means are of visual type.

17. An airplane, which comprises a device for implementing the method specified under claim 1.

18. An airplane, which comprises a device, such as that specified under claim 14.

* * * * *